US010661331B2

(12) United States Patent
Ivarson et al.

(10) Patent No.: US 10,661,331 B2
(45) Date of Patent: May 26, 2020

(54) STRIKING UNIT AND METHOD FOR MATERIAL PROCESSING BY THE USE OF HIGH KINETIC ENERGY

(71) Applicant: CELL IMPACT AB

(72) Inventors: Anders Ivarson, Karlskoga (SE); Erika Henriksson, Karlskoga (SE); Alem Buljubasic, Karlskoga (SE)

(73) Assignee: Cell Impact AB, Kariskoga (SE)

( * ) Notice: Subject to any disclaimer, the term of this patent is extended or adjusted under 35 U.S.C. 154(b) by 653 days.

(21) Appl. No.: 15/127,683

(22) PCT Filed: Mar. 6, 2015

(86) PCT No.: PCT/SE2015/050251

§ 371 (c)(1),
(2) Date: Sep. 20, 2016

(87) PCT Pub. No.: WO2015/152790

PCT Pub. Date: Oct. 8, 2015

(65) Prior Publication Data

US 2017/0136522 A1 May 18, 2017

(30) Foreign Application Priority Data

Mar. 24, 2014 (SE) ..... 1450335

(51) Int. Cl.
*B21J 9/00* (2006.01)
*B21J 9/20* (2006.01)
(Continued)

(52) U.S. Cl.
CPC . *B21J 9/20* (2013.01); *B21J 9/12* (2013.01); *B21J 13/02* (2013.01); *B21J 13/06* (2013.01); *B30B 15/16* (2013.01)

(58) Field of Classification Search
CPC ..... B21J 7/28; B21J 7/40; B21J 7/46; B21J 9/12; B21J 9/20
See application file for complete search history.

(56) References Cited

U.S. PATENT DOCUMENTS 5,832,807 A 11/1998 Rausch et al.
6,202,757 B1 3/2001 Dahlberg
(Continued)

FOREIGN PATENT DOCUMENTS

DE 37 11 384 A1 3/1988
DE 195 39 341 A1 5/1996
(Continued)

OTHER PUBLICATIONS

International Search Report issued in International Publication No. PCT/SE2015/050251 dated Jun. 10, 2015.
(Continued)

*Primary Examiner* — Debra M Sullivan
(74) *Attorney, Agent, or Firm* — Eric L. Sophir; Foley & Lardner LLP

(57) ABSTRACT

The present invention relates to a method at the material processing by the use of high kinetic energy, comprising a piston which is driven from a start position by a hydraulic system pressure (pS) by means of a drive chamber in order, by only one stroke, to transfer high kinetic energy to a blank/tool to be processed, whereafter there is a risk that a rebound of the piston will occur, and the method comprises that a step is taken in connection with said stroke performed, which step prevents said piston from making a rebound with an essential content of kinetic energy in order to avoid negative effects as a result of a rebound, whereafter the piston is returned to said start position by means of a second chamber, wherein said step comprises that a valve means closes the driving connection between the system pressure (pS) and the piston, wherein said step comprises that said valve means is controlled by a pilot valve controlling the entire striking progress, and that said second chamber is pressurized with the system pressure (pS) during the entire striking progress.

10 Claims, 8 Drawing Sheets

(51) Int. Cl.

| | |
|---|---|
| ***B21J 9/12*** | (2006.01) |
| ***B21J 13/06*** | (2006.01) |
| ***B21J 13/02*** | (2006.01) |
| ***B30B 15/16*** | (2006.01) |

(56) References Cited

U.S. PATENT DOCUMENTS

| | | | |
|---|---|---|---|
| 7,104,190 | B2 | 12/2006 | Dahlberg |
| 2004/0134254 | A1 | 7/2004 | Dahlberg |

FOREIGN PATENT DOCUMENTS

| | | | |
|---|---|---|---|
| JP | H08 206899 | A | 8/1996 |
| WO | 97/00751 | A1 | 1/1997 |
| WO | 02/090015 | A1 | 11/2002 |

OTHER PUBLICATIONS

Written Opinion of the International Searching Authority issued in International Publication No. PCT/SE2015/050251 dated Jun. 10, 2015.

European Communication under Rule 71(3) EPC, dated Mar. 13, 2018, in corresponding European Application No. 15 773 112.6, 31 pages.

Chinese Office Action (with English Translation), dated Sep. 25, 2018, issued in corresponding Chinese Application No. 201580016118.6, 4 pages.

European Communication dated Mar. 28, 2017 in European Application No. 15 773 112.6, 5 pages.

STRIKING UNIT AND METHOD FOR MATERIAL PROCESSING BY THE USE OF HIGH KINETIC ENERGY

CROSS-REFERENCE TO RELATED APPLICATIONS

This application claims priority to PCT/SE2015/050251, filed Mar. 6, 2015, which claims priority to Swedish Patent Application No. 1450335-3, filed Mar. 24, 2014, all of which are incorporated by reference in their entirety.

TECHNICAL FIELD

The present invention relates to a striking unit for a method for material processing by the use of high kinetic energy, comprising a piston for the transfer of high kinetic energy to a blank/tool to be processed, a drive chamber connected to a system pressure arranged to drive said piston, a valve arrangement arranged to control the flow to said drive chamber, and a control system for the regulation of said valve arrangement, wherein said control system, directly or indirectly, is connected to a sensor, by which said valve arrangement is controlled in connection to a first stroke by said piston, so that the force on the piston is reduced or disconnected, whereby an additional, subsequent stroke with an essential content of kinetic energy is prevented, as well as a method where a step is taken in connection to said performed strokes, which step prevents said piston from making a rebound with an essential content of kinetic energy in order to avoid negative effects because of a rebound.

BACKGROUND

At high-speed processing, high kinetic energy is used to form and/or process a material body. In connection with high-speed processing, striking machines are used where the press piston has essentially higher kinetic energy than at conventional processing. The press piston often has a speed, which is about 100 times higher or more than in conventional presses in order to perform cross-cutting and punching, forming of metal components, powder compacting- and similar operations. In high-speed processing there is a number of different principles to achieve the high kinetic energies necessary for the achievement of the advantages which the technique offers. A great number of different machines and methods accelerating a striking body has been developed, e.g. as shown in WO 9700751. Common for all these machines, whether they for the acceleration use air, oil, springs, air-fuel mixtures, blasting agents or electro-mechanics, has been that one has in principle triggered an uncontrolled process which results in the striking body accelerating towards a tool, and that one has thereafter in some way moved the striking body back after a certain time. Further, the accelerating forces have continued to effect the striking body after the first stroke, which has resulted in that several strokes have occurred after the first stroke. These additional strokes, re-strokes, are undesirable and often directly detrimental. Also in the case when a forming tool is used, e.g. at the forming of patterned plates, it is of vital importance that the forming tool does not come into contact with the blank two times or more as there then is a risk that the tolerances of the plates is not met.

Thus, it has been identified that principally without exceptions it is a drawback to subject the work-piece to be processed in a high speed process to more than one stroke.

This applies whether it is the question of cross-cutting, homogeneous forming or powder compacting. When it the question of cross-cutting, the additional unnecessary strokes may result in excessive tool wear and undesired burrs. At punching, smearing, welding, burrs and tool wear may occur. At homogeneous forming, there is the risk that undesired material changes occur, punches may crack, and the blank may be clamped unnecessarily hard in the matrix, which results in the forming force increasing with matrix wear as a consequence. At powder compacting with brittle materials such as ceramics, hard metals and the like, a second stroke may wreck the continuous body which one has managed to create in the first stroke. At powder compacting of soft powders such as copper and iron, for instance, the density will indeed continue to increase, if one strikes several times, but the blank is clamped even harder in the matrix with an increased number of strokes, which results in undesirable wear. A feasible reason for the fact that focus has not previously been put on this problem might be that these progresses are very rapid and may in many cases not been able to be observed, and therefore the detrimental effects of the re-stroke have seemed to be unexplainable. Further, the enormously short reply terms, which are required to make it possible to interrupt the acceleration of the striking body after the first stroke, imply a complication as such. If one accelerates a striking body by means of some gas, it has in principle been technically impossible to reduce the pressure in the drive chamber during the short time between the first and the second stroke (typically between two and fifty milliseconds). By means of hydraulics, it is technically possible, but most of the valves on the market have too long an adjustment time to be able to be used at the short adjustment times which may be required, often an adjustment within twenty milliseconds. As to spring machines, it is rather evident that it is somewhat difficult to form a mechanical device slacking on the spring bias within a few milliseconds. As indicated above, most known hydraulic high speed machines are equipped with valve mechanisms which cannot be adjusted quick enough to hinder the advancing oil and hence the creation of pressure in the drive chamber of the piston. The reason for this is that hydraulic valves for high flows (300 to 1000 litres/minute) normally require comparatively long adjustment times. This depends in its turn on the fact that the valve body quite simply has to move a comparatively long distance so that an enough large opening area will be created so that the oil will be able to pass through it without too large a pressure fall.

SUMMARY

An object of the present invention is to eliminate, or at least minimize, the problems mentioned above, which is achieved with a method and a striking unit.

Thanks to the invention, a method and a device are provided, which at high speed processing may be used in a manner resulting in a higher quality than what has been known previously.

According to an aspect of the invention, it is a great advantage to be able to change the flow, and hence the pressure in the drive chamber, as quickly as possible, to be able to adjust the piston to its start position for the next stroke. The best solution is obtained with short paths and a high flow. Optimized dimensioning of cistern conduit systems and cistern accumulators provides a quick and effective pressure reduction and return of the piston, i.e. the piston may be "caught" without obtaining any double-stroke/double-bound.

According to another aspect of the invention, one on-off valve or more is used, preferably functioning according to the principle for cartridge valves to control the striking progress, which may offer the advantage that it gives a low cost as compared with other alternatives and also the advantage that it permits a quick adjustment time at large flows.

According to still an aspect of the invention, one return valve or more, which offers the advantages that the drive chamber is emptied quicker and relieves the other valves.

According to an additional aspect of the invention, at least one accumulator is used, preferably a so called high-flow accumulator, which is arranged at the non-return valve/s, connected to a cistern which provides advantages of reduced pressure peaks in the system and a quicker emptying of the drive chamber.

According to still an aspect of the invention, a pilot pressure, which is suitably higher than the system pressure, is connected to the pilot valve, which results in a quicker closing of the on-off/cartridge valve, which implies a quicker emptying of the drive chamber and which also guarantees that the on-off/cartridge valve is kept closed except at strokes.

According to an aspect of the invention, a step is taken in connection with the forming of patterned plates, which step prevents the forming tool from contacting the blank to be formed more than once.

According to another aspect of the invention, the step comprises that a well-defined holding force presses the upper tool element towards the blank to be formed, before the stroke takes place, with such a force that the upper tool element is not allowed to bounce upwards after a stroke, which prevents detrimental rebounds on the blank.

According to still an aspect of the invention, the step comprises that air is blown in between the upper tool element and the blank after a stroke, which air forms an air bag resulting in that the upper tool element does not reach the blank at a rebound and hence prevents damages on the blank.

According to an additional aspect of the invention, the step comprises that damping/resilient elements are arranged in connection to the upper tool element and that the elements exert a resilient force upwards towards the upper tool element, which is large enough to prevent the upper tool element from reaching the blank at a rebound.

BRIEF DESCRIPTION OF DRAWINGS

Below, the invention will be described more in detail with reference to the enclosed drawings, of which.

DETAILED DESCRIPTION

Figure 1:
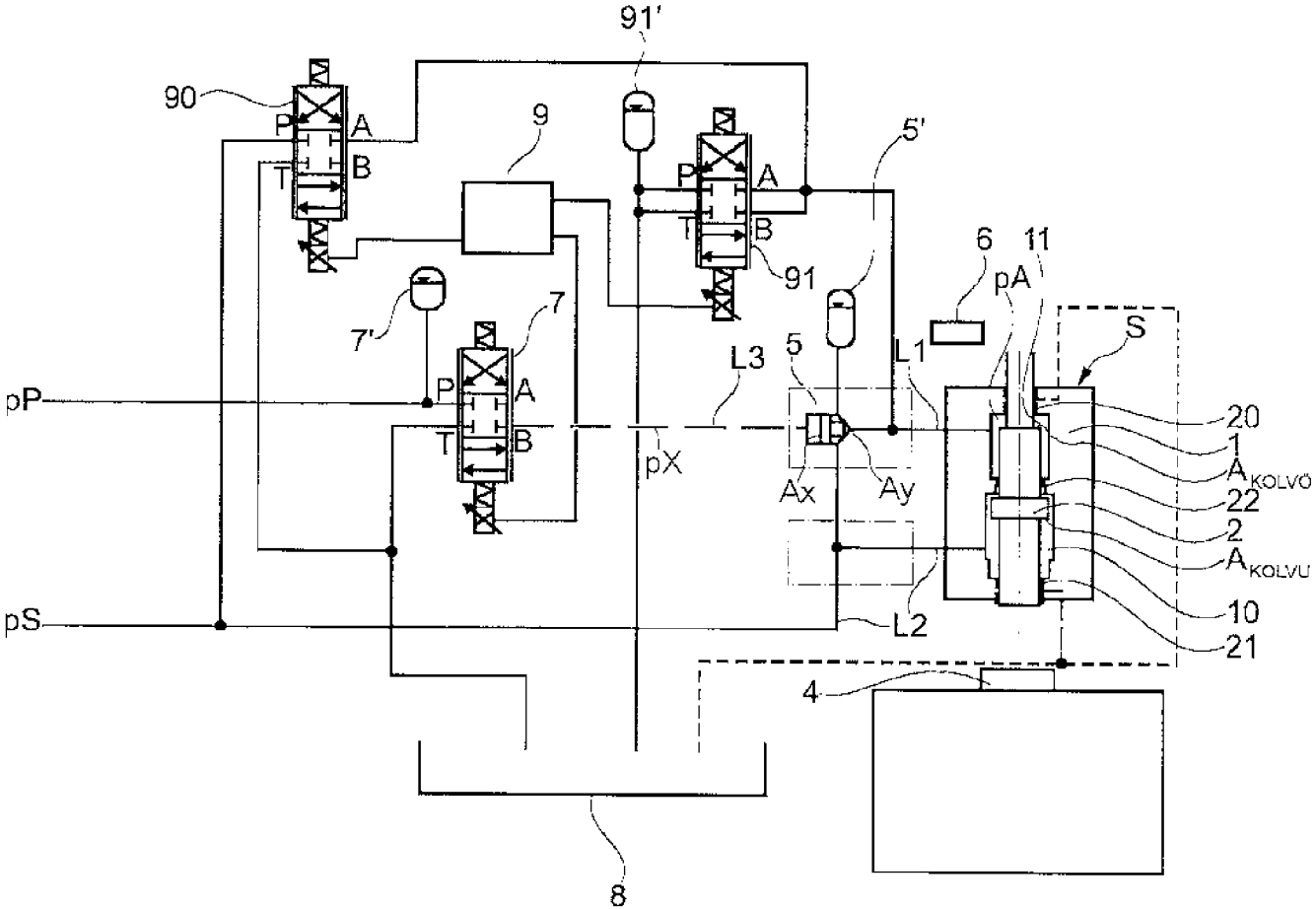
FIG. 1 shows the principles of a striking unit according to the invention.

FIG. 1 shows a fundamental hydraulic chart for a striking unit S in a preferred embodiment of the invention, where crossing conduits without points do not communicate. The figure shows a striking unit S comprising a cylindrical housing 1, containing a through work piston 2. Preferably, the piston 2 is journalled in its two ends with a first bearing 20 and a second bearing 21. There is also a third bearing 22 in the middle of the piston implying that two chambers are formed, a drive chamber 11 and a second chamber 10. The piston 2 is intended to transfer high kinetic energy to a blank/tool for high speed processing. The drive chamber 11 is connected to a valve means 5, a pressure-controlled on/off-valve, preferably a cartridge valve, via a first conduit L1. The cartridge valve 5 is via a conduit L3 connected to a pilot pressure pP, via a valve, preferably via a pilot valve 7. The expression pilot valve means some kind of valves fulfilling the functionality of controlling the on-off/cartridge valve 5, which preferably comprises a multipath valve, which by means of a comparatively small hydraulic flow may quickly adjust an on/off valve for a larger flow. Further, the cartridge valve 5 is connected to a system pressure pS via a conduit L2. The cartridge valve 5 is also connected to a pressure accumulator 5' in order to achieve a rapid pressure increase in the drive chamber 11 at acceleration. Also the pilot valve 7 is connected to a pressure accumulator 7', which contributes to a quicker emptying of the drive chamber 11. The second chamber 10 is connected to a system pressure pS via a conduit L2. The chart also includes a control system 9, a sensor 6, a servo valve 90 and a non-return valve 91. The non-return valve 91 is connected to a cistern accumulator 91' to contribute to a quicker emptying at a pressure reduction.

The three bearings 20, 21, 22 mentioned above have preferably mutually different diameters, which implies that the effective areas of the piston 2 in the drive chamber 11 and the second chamber 10, respectively, differ. The effective area $A_{kolvö}$ of the piston 2 in the drive chamber, which the oil influences, is larger than the effective area $A_{kolvu}$ in the second chamber 10. In the second chamber 10 there is preferably always a system pressure pS. The pressure pA of the drive chamber 11 may be considerably lower than the system pressure pS to keep the piston 2 in balance. The following relation is valid to keep the piston 2 in balance, where $m_{kolv}$ is the mass of the piston 2 and g is the acceleration due to gravity:

$$pA \times A_{kolvö} m_{kolv} \times g = pS \times A_{kolvu}$$

In order to be able to operate the cartridge valve 5 safely and rapidly, a pilot pressure pP is preferably used, which is larger than the system pressure pS.

Figure 2:
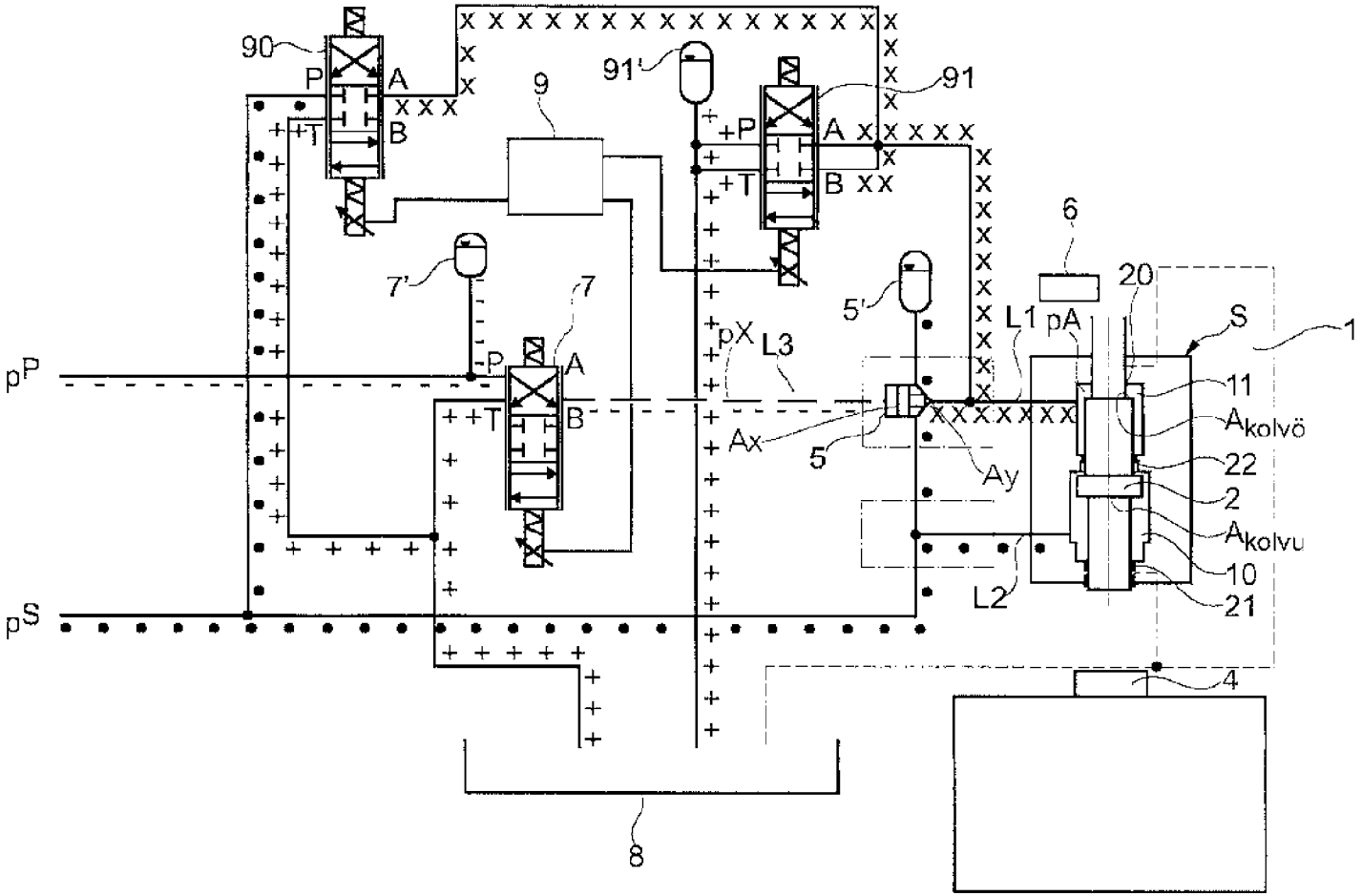
FIGS. 2 to 5 show four different work cycles of the striking unit.

The work cycle of the striking unit S may be divided into four parts: Positioning, Acceleration, Hit and Return Motion To symbolize the pressures which exist in different conduits in FIGS. 2, 3 and 5 in the different cases, the pressures are symbolized according to the following: pP=––––, pS=• • • • •, $p_{regler}$=xxxxx, and $p_{tank}$=++++++, wherein preferably $pP > pS > p_{regler} > p_{tank}$ In FIG. 2 the step Positioning is shown, where the control system 9 keeps the piston 2 at a pre-chosen distance from the blank/tool 4 by means of a servo valve 90. The current position of the piston 2 is measured by the sensor 6, and by means of an adjustment function the control system 9 adjusts the piston 2 to the chosen position by means of the servo valve 90 by adjusting the pressure $p_{regler}$ in the conduit L1. If the piston 2 is too far from the blank/tool 4, the pressure $p_{regler}$ will be increased and hence the piston 2 is moved closer to the tool. If the piston 2 is too close to the blank/the tool 4, the pressure $p_{regler}$ will be reduced and hence the distance to the tool is increased. When the piston 2 is at the pre-chosen distance, it is kept in balance according to the balance condition above. The pressure pX is the pressure existing in the conduit L4 and acting on the operation area Ax of the cartridge valve cone. The pilot valve 7 is put in a maximally negative open state (P→B), so that pX=pP, and hence the cartridge valve 5 is kept closed. This guarantees that it does not enter into the system pressure pS to the drive chamber 11. The non-return valve 91 is closed and put into a center position during the positioning.

Figure 3:
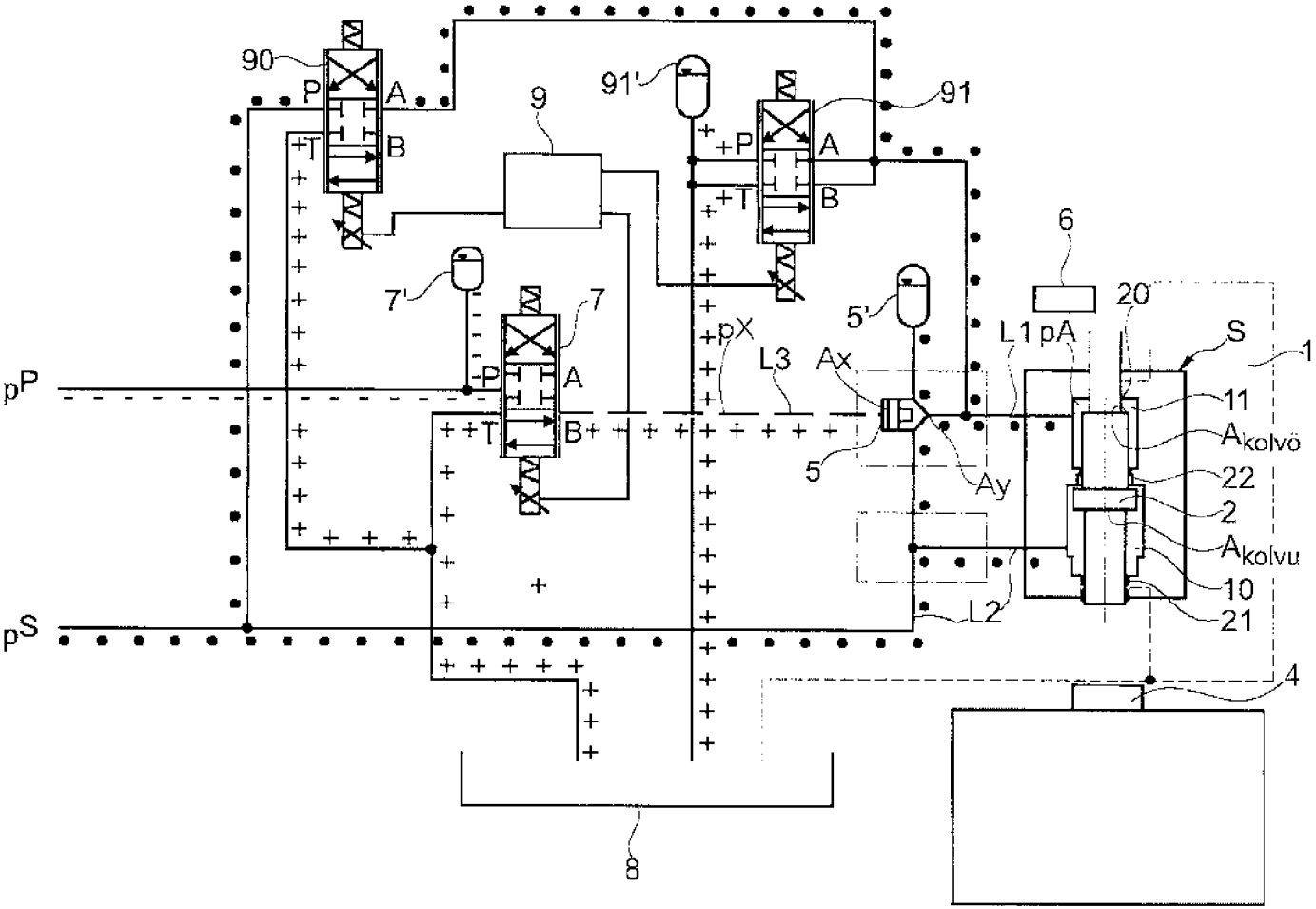

In FIG. 3 the step Acceleration is shown, where the adjustment function is inactivated, wherein the servo valve 90 is put into a center position at the same time as the pilot valve 7 opens (somewhat) positively (B→T), so that the operation area Ax of the cartridge valve cone is connected to a cistern 8. Then, the pressure pX will fall and the cartridge valve 5 opens, as the pressure at the other side of the cone is larger, which implies that a instantaneous connection to the system pressure pS in the drive chamber 11 is obtained. With the system pressure pS also in the drive chamber 11 a resultant downwardly directed force is obtained, when:

$$pS \times A_{kolvö} + m_{kolv} \times g > pS \times A_{kolvu}$$

which implies that the piston 2 quickly accelerates downwardly, often with a resultant speed of well above 10 m/s, rather often above 12 m/s. The cartridge valve 5 thus connects the system pressure pS with the first conduit L1, so that the drive chamber 11 is pressurized, and connects then also the flow path between the chambers, via L1 and L2, so that oil which has been displaced from the lower chamber 10 may flow to the drive chamber 11. Thanks to the fact that the cartridge valve 5 is connected to the pressure accumulator 5' a quick pressure increase in the drive chamber 11 is reached.

The non-return valve 91 is closed and put in the center position during acceleration.

Figure 4:
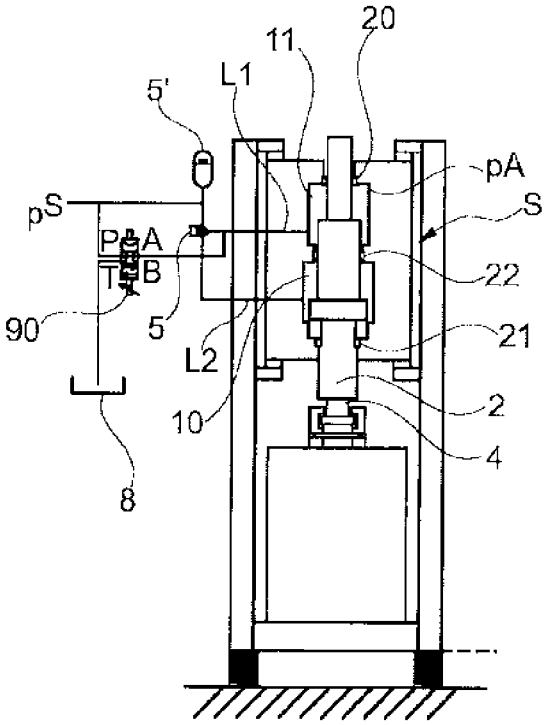

FIG. 4 shows the step Hit. The piston 2 hits the blank/tool 4 to be processed and gets through its own elasticity and the elasticity of the blank/tool a certain return motion/bound. As the piston 2 has an approximately constant acceleration until it hits the blank/tool 4, the hit speed depends on the distance to the blank/tool 4 at the positioning before the acceleration phase.

Figure 5:
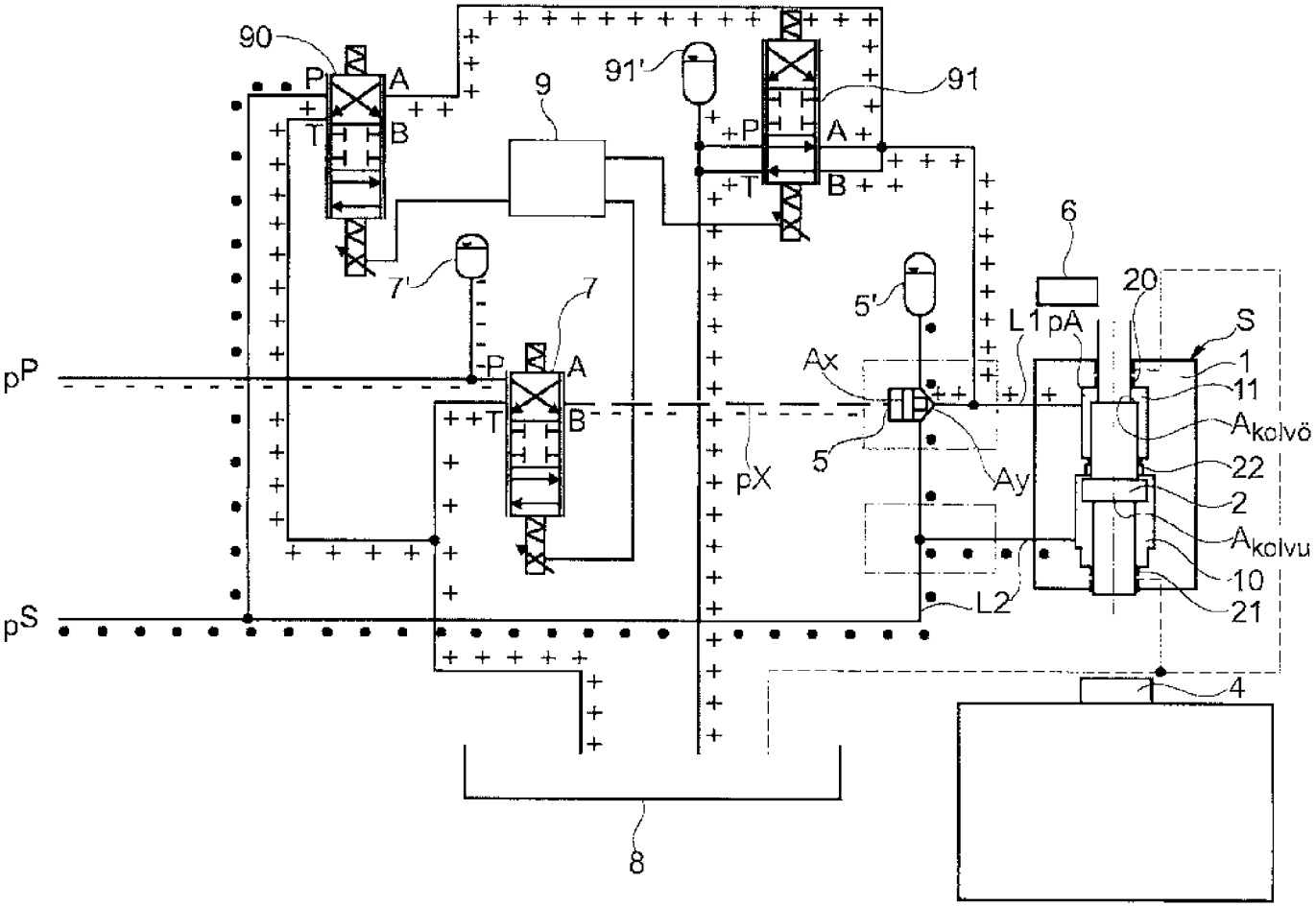

FIG. 5 shows the step Return Motion. After the hit, the pressure pA in the drive chamber 11 has to be quickly reduced, so that the piston 2 is not again forced downwards and risks to make a second hit. The pilot valve 7 is put to a negatively open position, so that the operation area Ax of the cartridge valve cone obtains the pressure pP and moves towards a closed position. The non-return valve 91 is put to a positively maximal position so that the drive chamber 11 is connected to the cistern 8, wherein the system pressure pS in the second chamber 10 drives the piston 2 away from the blank/tool 4. (May in this case instead be opened to a negatively maximal position, which gives the same function, as the openings P and T are connected and the openings A and B are connected). The adjustment function is activated, which implies that the servo valve opens negatively (A→T) to reduce the pressure in the drive chamber 11 and to control the piston 2 to the determined start position according to the step Positioning. The start position needs not be the same from stroke to stroke but may vary. By means of the sensor 6, which stands in communication with the control system 9, the position of the piston 2 may be sensed, and after a certain time period or at a predetermined position of the piston a signal is given to the control system 9, which influences the different valves as described above. As well the pilot valve 7 as the non-return valve 91 are thus connected to the accumulators 7', 91', which contribute to a quicker emptying of the drive chamber 11.

It is very advantageous as quickly as possible to empty the drive chamber 11 to be able to adjust the piston 2 to the start position for the next stroke. Thanks to the design described above, a solution with short paths and a high flow, an optimal dimensioning of the cistern conduit system and cistern accumulators is obtained, which results in a quick and effective pressure reduction and a return of the piston 2, i.e. the piston 2 may be "caught" without obtaining double strokes/double bounds. A cistern accumulator of the "high flow" type (usually equipped with a disk valve) is preferred, in order to be able to handle large/quick flows, preferably min. 900 l/min, more preferred min. 1,000 l/m. Suitably the accumulator (or more) is adapted so that the risk is avoided that it reaches/they reach the bottom, i.e. the dimensioning should be such that a certain auxiliary volume remains also at a maximal demand.

The adjustment of the piston position before a stroke is performed by means of a servo function in accordance with the description above. The control system 9 gives a dynamic control of the servo valve 90 and the pilot valve 7, which influences the cartridge valve 5 for a stroke by dynamically calculating the time control based on the model of the striking unit, distance-time function, the stroke length chosen, etc. Output from the calculation gives a time for how long time it takes for the piston 2 to reach an impact cap 41, and thereafter it is used as input to close the valves. The choice of parameters for the adjustment algorithm is adapted to the respective striking unit S. Preferably, it may be adaptive after the calculation of the start parameters. It is the question of extremely quick progresses, which provides a control accuracy of tenths of a millisecond.

Thus, the function of the pressure accumulators is first of all to guarantee that there is oil enough during quick progresses. Without the pressure accumulators a much larger pump would have been required to be able to meet the large flows occurring during a short time. The cistern accumulators relieve the system by making it possible for them temporarily to be filled with oil, when the drive chamber is to be emptied. It would also take much longer time before the pressure is reduced, as the oil then must be emptied to the cistern 8 through cistern conduits with the drawback that, except the long path, there is a certain resistance in the hoses.

Figure 9:
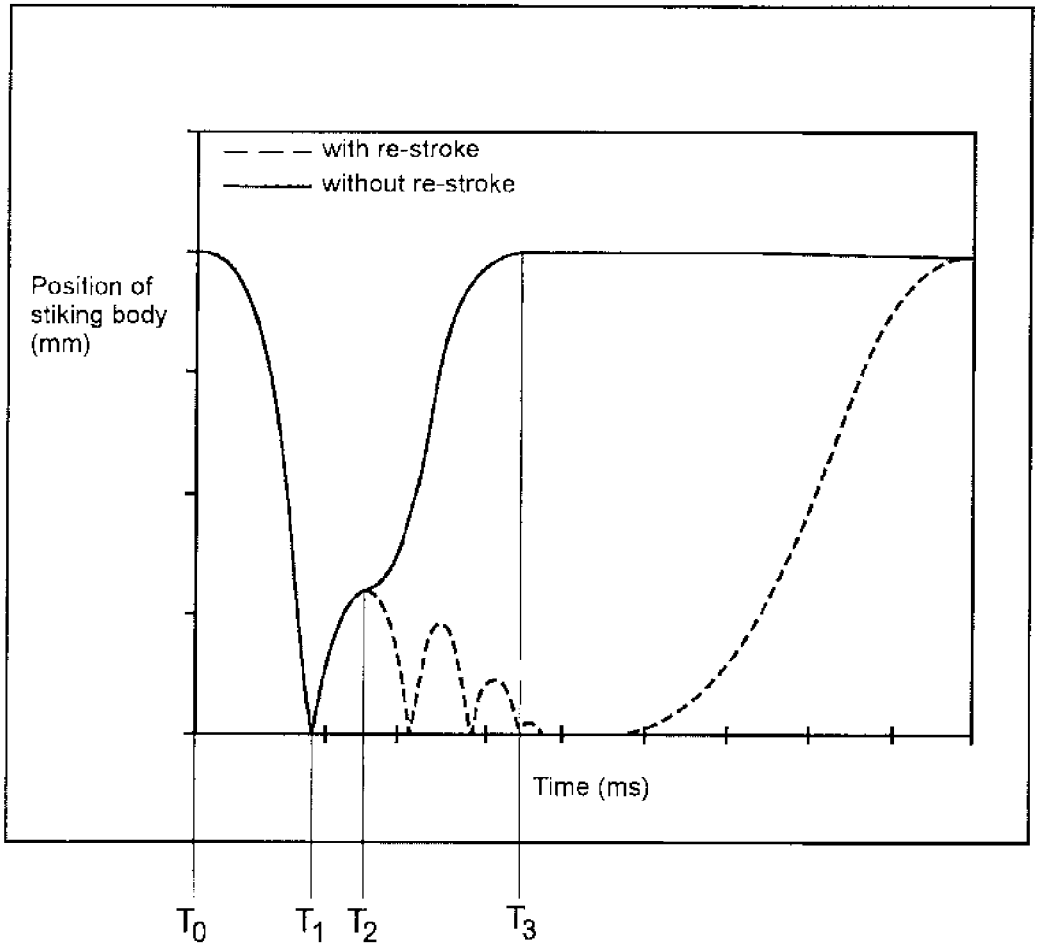
FIG. 9 shows a chart of the striking progress.

FIG. 9 shows a chart indicating when the different work cycles take places at a striking progress. On the X-axis of the chart the time is shown in ms and on the Y-axis of the chart the position of the striking body is shown in mm. The continuous line shows a stroke performed according to the invention, while the broken line shows how a conventional stroke takes place. It may be seen that the two curves accompany each other during a first lapse of time, i.e. exactly the same acceleration and motion is achieved from the start position $T_0$ to the accomplishment of a stroke as well during part of the return motion. According to a conventional method, a number of re-strokes hereafter occur, which may result in undesirable consequences. According to the invention, this is avoided as the flow is rapidly changed in the drive chamber 11 and a quick emptying may be performed. At $T_0$ the acceleration thus starts, at $T_1$ the hit occur, at $T_2$ the piston 2 is caught and the return motion takes place, and at $T_3$ a new positioning of the piston 2 occurs, according to the description above.

Figure 10:
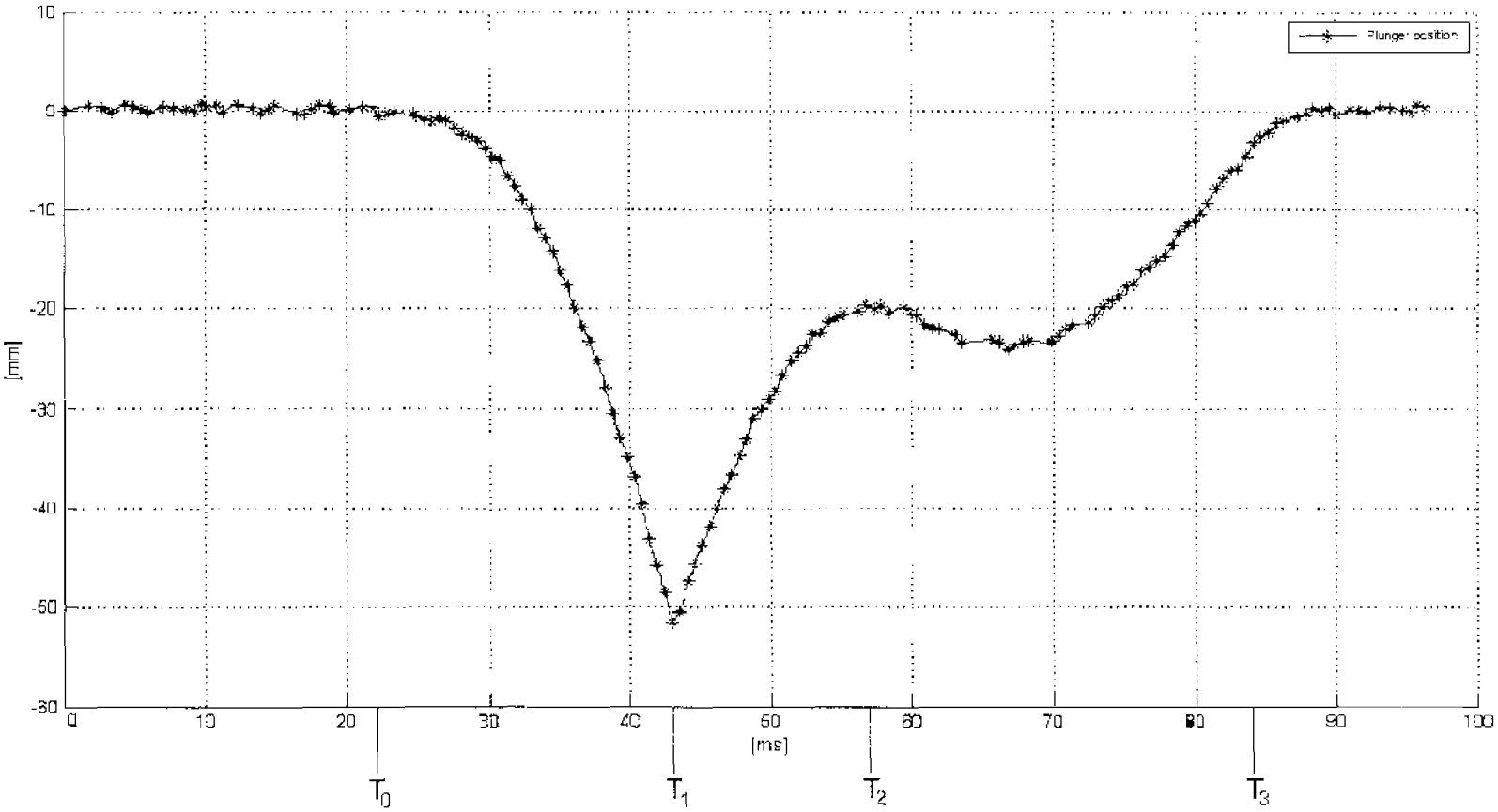
FIG. 10 shows a chart of the striking progress for a real stroke.

FIG. 10 shows a chart of a real stroke, when the piston 2 has a mass of 250 kg and the mass of the anvil and the tool is 12 tons. On the X-axis of the chart the time is shown in ms and on the Y-axis of the chart the position of the piston is shown in mm. The start position is marked $T_0$, i.e. here the acceleration starts, at $T_1$ a hit occurs, at $T_2$ the piston 2 is caught, and at $T_3$ a new positioning of the piston 2, takes place, i.e. a time of 35 ms from start ($T_0$) to the capture ($T_2$) of the piston 2.

Depending on the machine size and the striking parameters the time between the start of the acceleration ($T_0$) and the new control of the piston 2 by the control system ($T_2$) may be in the range of 2 to 500 ms. More preferred the time range below is dependent of the mass of the piston 2:

The mass of the piston is up to 25 kg. The preferred time range is 2 to 50 ms, more preferred below 30 ms.

The mass of the piston is 25 to 250 kg. The preferred time range is 4 to 150 ms, more preferred below 80 ms.

The mass of the piston exceeds 250 kg. The preferred time range is 8 to 300 ms, more preferred below 150 ms.

Figure 6:
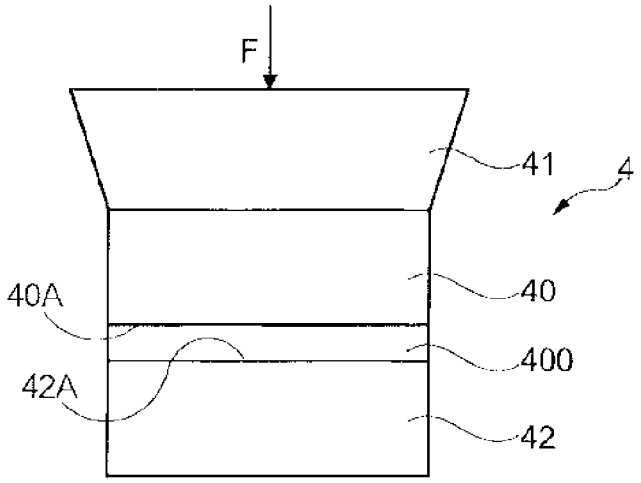
FIG. 6 shows a tool solution according to the invention.

The mass of the anvil and the tool is advantageously larger than the mass of the piston 2 so that the piston 2 will bounce at a hit. It is also possible to practise the invention if the mass of the anvil and the tool is equal to or somewhat smaller than the mass of the piston 2, but the foregoing is usually preferred. FIG. 6 shows a cross-sectional view of a tool solution 4 to avoid double-bounds according to the invention, seen from the side. The figure shows a tool set comprising a lower tool element 42, an upper tool element 40, and impact cap 41 arranged on top of the upper tool element, wherein the tool elements 40, 42 are movable in relation to each other. The tool elements 40, 42 often comprise a patterned surface towards the blank to be processed but they may also be smooth. The material 400 to be processed is arranged between the lower tool element 42 and the upper tool element 40. The tool set is arranged in a tool housing, not shown, which is arranged on a stationary or movable anvil. Depending on how the finished product/plate 400 is to look like, at least one of the tool elements 40, 42 often comprises an engraving 40A, 42A, which is congruent with the surface of the finished product/patterned plate 400. The lower tool element 42 is preferably stationary and consists of a pad, while the upper tool element 40 is a punch striking towards the pad with the blank 400 to be formed arranged therebetween. In the case shown in FIG. 6 the impact cap 41 is pressed towards the upper tool 40, which in its turn presses against the blank 400 with a well-defined holding force F (preferably from some tons and upwards depending on the pressure force/energy necessary for the forming work). This force F is so large that the tool is not permitted to bounce upwards after a stroke. The forming of the plate 400 takes place by the tool elements 40, 42 striking towards each other as the piston 2 with very high kinetic energy is struck against said impact cap 41. The tool 40 and the impact cap 41 are suitably pressed by a spring force against the blank 400. It is also possible that the impact cap 41 and the upper tool element 40 are an integrated unit, which would imply that the need to keep them connected then would be deleted. It is advantageous also at the forming of patterned plates 400 if a forming tool 4 does not come into contact with the blank two times or more as there then is a risk that the tolerances of the plate 400 is not met.

Figure 7:
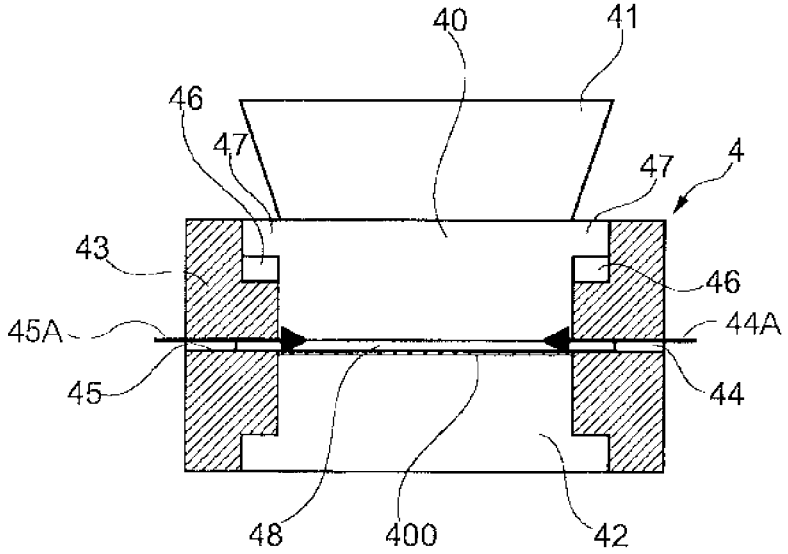
FIG. 7 shows an alternative tool solution according to the invention.

FIG. 7 shows an alternative embodiment to prevent rebounds against the blank 400 to be formed. The figure shows parts of the tool housing 43, containing a tool elevator comprising a lower tool element 42, an upper tool element 40 as well as a impact cap 41 arranged on top of the upper tool element, wherein the tool elements are moveable in relation to each other. The tool elevator is pressed with a well-defined holding force against the periphery of the blank 400, and the material/plate 400 to be formed is arranged between the tool elements 40, 42. The upper tool element 40 comprises in its upper part a border 47 extending upwards on each side. The tool housing 43 is constructed with a corresponding cavity 46 so that the border 47 will get space to move downwards at a stroke by the striking piston 2 against the impact cap 41. At the forming of the plate 400, the piston 2 is struck with very high kinetic energy against said impact cap 41. The upper tool element 40 bounces upwards after a stroke, and air, alternatively some other gas, is blown into the space formed between the upper tool elements 40 and the plate 400 (see arrows 44A, 45A) via channels 44, 45 in the tool housing 43. The air blown into the space 48 forms an air bag which prevents the upper tool element 40 from reaching the plate 400 when it falls down again.

Figure 8:
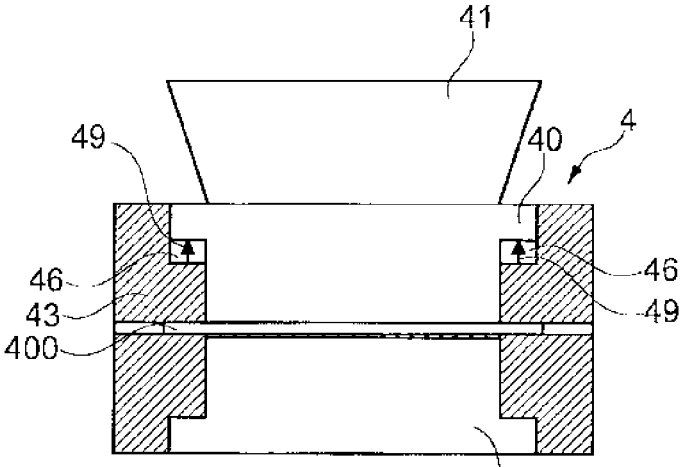
FIG. 8 shows still an alternative tool solution according to the invention.

FIG. 8 shows still an alternative embodiment of a forming tool 4, which is advantageous to use at the production of stamped plates, when the material is so thin that, if the tool solution 4 described in FIG. 6 would be used, the material has already been completely processed by the exerted force F. In the example shown, a damping/resilient element is preferably arranged in the cavity 46, between the tool housing 43 and the border 47 of the upper tool element. The element 49 exerts a spring force upwards against the border 47 of the upper tool element, a spring force which is small enough so that the forming will not be hindered (however, it gives resistance so that somewhat more forming energy is required than if it had not been there). At the forming of the blank 400 the piston 2 is struck with very high kinetic energy against said impact cap 41. After the forming, when the piston 2, the impact cap 41 and the upper tool element 40 have left the blank 400, the spring force is large enough to prevent the upper tool element 40 from reaching the blank 400 again.

It is realized that the different embodiments of the tool solutions described with reference to FIGS. 6 to 8 as such may be the subject for divisional applications.

The invention is not limited to the description above but may be varied within the scope of the following claims. For instance, it is realized that the number of valves and accumulators as well as their size in the examples described may vary, the number and the size is dependent on the size of the machine. In the description, a cartridge valve is described as an example, but it is realized that also other quick valves may be used. The man skilled in the art realizes that the invention idea also comprises another material processing than the one described above, e.g. punching, cross-cutting, stamping, and compacting of powders, and that the striking unit may be inverted so that the piston strikes upwards instead of downwards, as described. It is also possible that a striking unit and an anvil is placed on resilient feet, so that the anvil may move. In this way, the anvil may get a counter-directed motion towards the acceleration of the piston. Although a cartridge valve without any spring is shown in the figures, the man skilled in the art realizes that the invention idea comprises cartridge valves both with and without springs.

What is claimed is:

1. A method of processing a material using kinetic energy, comprising:

driving a piston from a start position via a system pressure within a drive chamber, wherein the system pressure transfers the kinetic energy to a blank/tool to be processed, while subjecting the blank/tool to only one stroke;

returning the piston to the start position via a second chamber; and controlling the driving step and the returning step via a valve that closes a driving connection between the system pressure and the piston, and a pilot valve that controls the valve during an entire striking progress comprising the driving step and the returning step; wherein the second chamber is pressurized at the system pressure during the entire striking progress; and wherein the controlling step prevents a rebound of the piston on the blank during the entire striking progress.

2. The method of claim 1, wherein at least one of the valve and the pilot valve is connected to a pressure accumulator.

3. The method of claim 1, wherein the controlling step is performed during a time period between 50 ms before and 50 ms after the piston hits the blank/tool.

4. The method of claim 1, wherein the controlling step is performed by a control system in response to at least one signal received from at least one sensor.

5. The method of claim 1, comprising disposing the blank to be formed between an upper tool element and a lower tool element of a tool set in a striking unit, wherein the tool set comprises an impact cap located on top of the upper tool element, and wherein the upper tool element and the lower tool element are movable relative to each other; further comprising the step of forming the blank by the piston striking against the impact cap to cause the upper tool element and the lower tool element to strike against each other with kinetic energy.

6. The method of claim 5, comprising, before the stroke takes place, pressing the impact cap against the upper tool element and pressing the upper tool element against the blank with a well-defined holding force, wherein the holding force is sufficiently large that the upper tool element cannot bounce after a stroke.

7. The method of claim 5, wherein the tool set is arranged in a tool housing, the method further comprising the step, in the event the upper tool element bounces upward after the stroke, of blowing air into a space between the upper tool element and the blank via channels in the tool housing to form an air buffer, wherein the air buffer prevents the upper tool element from reaching the blank when the upper tool element falls down after the bouncing upward.

8. The method of claim 5, comprising connecting a damping/resilient element to the upper tool element, the damping/resilient element exerting a spring force large enough to prevent the upper tool element from reaching the blank after the stroke.

9. The method of claim 1, wherein the valve that closes the driving connection between the system pressure and the piston is a pressure controlled shut-off valve, wherein the controlling step further comprises controlling an activation of the pressure controlled shut-off valve to control the connection of the drive chamber to the system pressure.

10. The method of claim 9, wherein the pilot valve controls the pressure controlled shut-off valve by regulating a pilot pressure for controlling the activation of the pressure controlled shut-off valve, wherein the pilot pressure is higher than the system pressure.

* * * * *